US006227469B1

(12) United States Patent
Daniels, Jr. et al.

(10) Patent No.: US 6,227,469 B1
(45) Date of Patent: May 8, 2001

(54) COMMINUTING MACHINE

(75) Inventors: William E. Daniels, Jr., Moody, AL (US); Richard E. Preator, Jr., Peculiar, MO (US)

(73) Assignee: Precision Husky Corporation

( * ) Notice: Subject to any disclaimer, the term of this patent is extended or adjusted under 35 U.S.C. 154(b) by 0 days.

(21) Appl. No.: 09/429,753

(22) Filed: Oct. 28, 1999

(51) Int. Cl.[7] ..... B02C 13/286
(52) U.S. Cl. ..... 241/186.3; 241/190; 241/189.1
(58) Field of Search ..... 241/73, 88.4, 243, 241/190, 191, 189.1, 195, 194, 186.3

(56) References Cited

U.S. PATENT DOCUMENTS

| | | | |
|---|---|---|---|
| 1,786,694 | 12/1930 | Borton . | |
| 2,405,692 | 8/1946 | Hall . | |
| 2,812,790 | 11/1957 | Stuart, II . | |
| 2,969,095 | 1/1961 | Brookhyser et al. . | |
| 3,025,895 | 3/1962 | Girard . | |
| 3,219,076 | 11/1965 | Logan et al. . | |
| 3,447,758 | 6/1969 | Oznobichine . | |
| 3,661,192 | 5/1972 | Nicholson et al. . | |
| 4,077,450 | 3/1978 | Ackerman . | |
| 4,133,489 | 1/1979 | Maillet . | |
| 5,413,286 * | 5/1995 | Bateman | 241/190 |
| 5,472,147 | 12/1995 | Doppstadt . | |
| 5,628,467 | 5/1997 | Graveman . | |

* cited by examiner

*Primary Examiner*—Mark Rosenbaum
(74) *Attorney, Agent, or Firm*—Bradley Arant Rose & White, LLP

(57) ABSTRACT

A hammermill grinder that eliminates the frequent jamming caused when cutting heads catch on material that enters the lower segment of the rotary cutting arc and then feeds at a rapid rate equal to the rotation of the the hammermill into and under the hammermill, without first being reduced. The hammermill possesses two levels of cutting heads, preferably spinning on a horizontal axis of rotation, and employs shredder feet to limit the depth of cut, both preventing wide items from being drawn into compression between the backing grate and the hammermill, and influencing material more efficiently into the cutting area.

9 Claims, 16 Drawing Sheets

COMMINUTING MACHINE

BACKGROUND OF THE INVENTION

1. Field of the Invention

This invention relates to the field of comminuting machines, such as the types employed for reducing demolition waste, land clearing debris, construction waste, trimmings, cuttings, and recyclables. The invention is directed more particularly toward an apparatus that employs a hammermill oriented along a horizontal axis of rotation with a horizontal in-feed of material, though the elements of the present invention can be practiced effectively in machines wherein the axis of rotation lies along an alternate plane, or in which the in-feed is of a different direction or orientation.

2. Description of Related Art

This invention relates specifically to a high-capacity horizontal-feed wood and debris shredding system, though it is to be understood that the invention is equally applicable to consumer grinders, mulchers, chippers, and other relatively low capacity waste reducers and recyclers. It is generally known in the art that horizontal feed mechanisms, such as conveyors or compression drives, can be utilized to feed material into a rapidly spinning "hammermill." A hammermill is essentially a drum, rotor, or series of plates substantially forming a cylinder, possessing teeth protruding from the outer surface of the drum, which teeth, ("cutting heads"), incrementally chop away the material being fed by the feed mechanism.

Such horizontal feed mechanisms are desirable because they allow for continuous, rather than batch, feeding of material to be comminuted. From the standpoint of effective and efficient comminuting, the in-feed should preferably deliver material to a horizontal hammermill in a manner that the hammermill will strike the material on the hammermill's downstroke. When material is struck by the downstroke of the hammermill, the material, while being struck, is momentarily wedged securely between the cutting head and the body of the apparatus, which houses the hammermill, resulting in a stable surface upon which the cutting heads of the hammermill can act. This stability allows substantially each stroke to impact the material in an optimum position, and each subsequent stroke to impact the material at the subsequent optimal position.

By contrast, when the in-feed delivers material to the hammermill at the up-stroke (i.e., "up-running hammermills"), the efficiency of the apparatus is significantly reduced. Because the upward rotation of the hammermill prevents the body of the apparatus from positioning and securing the material for a firm strike. Instead, the material tends to bounce away from the hammermill in response to the strike of the cutting heads. Elemental physics teaches that this results in an inefficient dissipation of the energy of the hammermill's strike. Furthermore, because of the bouncing effect, the subsequent strike point of the cutting heads on the material is a matter of chance. As a result, each strike is likely to be too shallow or too deep for efficiency.

Furthermore, the down-striking (i.e., "down-running") hammermill of the current invention maximizes safety, as material that is broken free by the hammermill is immediately directed downward and within the mechanism. Conventional 'tub grinders' and up-running hammermills may throw material relatively long distances away from the mechanism, increasing the potential for bodily injury or property damage. This known tendency prevents recommended use of tub grinders in urban areas because of the distance objects potentially may be thrown. The users of tub grinders are accustomed to determining a "danger zone" in which thrown objects may land. A significant advantage of the hammermill of the current invention, however, is the reduced size of this "danger zone." The improved characteristics of the present invention create a smaller "danger zone" and under appropriate conditions and precautions potentially allow the use of the apparatus in urban areas and more populated spaces than tub grinders, with a greater expectation of safety in these areas.

Although the efficiency and safety of a down-running horizontal hammermill is recognized in the art, the application of the conventional construction of comminuting machines to such horizontal configurations has lead to unacceptable binding of material between the cutting heads and the body of the apparatus. The difficulties arise from relatively slender material of high compression strength, having lost contact with a restricting feed mechanism, entering the cutting area while oriented substantially parallel to the axis of rotation of the hammermill. When this occurs, the slender material can enter the hammermill cutting radius between the recessed portions of the cutting heads and the in-feed platform or the body of the apparatus. When this causes the material to exert pressure against a substantial length of the hammermill, of the hammermill may either jam or be damaged.

Numerous attempts in the art have been made to overcome the operational inefficiencies caused by binding jamming of hammermills. Some attempts have misidentified the problem, or at best, addressed relatively minor issues affecting performance of hammermills. A primary example is U.S. Pat. No. 5,628,467, issued to Graveman, which is primarily applied to up-running hammermills. Graveman identifies the problem with hammermill efficiency as caused by (1) windage, and (2) material becoming caught between cutting heads and rotating with the hammermill. To address these problems, Graveman teaches the use of "comb" fingers which extend into the circle defined by hammer elements, specifically, into the interstices between hammer elements. Graveman's combs fail to address the problem of material jamming between the hammers and the apparatus floor. Rather, they have the dual purpose of (1) raking out material from the hammermill which has become caught between adjacent hammers, and (2) preventing windage. In fact, Graveman initially places the comb at the outlet of the apparatus, rather than at the inlet. In such a configuration the combs cannot prevent material from being jammed between the hammer and the apparatus body.

Furthermore, while Graveman does supply an alternate embodiment employing combs at the inlet, the configuration taught still allows binding of the material against the housing, due to the placement and curvature of the housing. Additionally, the combs extend into interstices between all of the cutting heads regardless of length, which requires the comb teeth to be offset from the cutting heads; this arrangement necessitates a gap between each set of cutting heads that is large enough to allow clearance for the combs. This same clearance causes substantial material to remain uncut. Specifically, hardwoods and other resilient material will remain uncut at locations corresponding to the interstices between cutting heads. In real-world conditions, the material will take on a configuration similar to that of the comb, with fingers extending into the interstices. As the material is driven more deeply into the hammermill, the fingers of the material are forced against the shaft or other non-cutting elements of the hammermill, causing it to bind. The current invention, by contrast, orients shredders directly in line with shorter cutting heads, rather than maintaining some off-set from all cutting heads, as in Graveman. Also, the Graveman patent employs pivoting cutting heads, indicating that Graveman has not overcome the potential for binding addressed by the present invention. The orientation of the Graveman combs and the pivoting action of the cutting heads fails to address the dual problems of lengthwise entry of material and binding against the drive mechanism.

To avoid striking the comb elements that are positioned to remove major accumulation, Graveman discloses hammering elements of longer and shorter lengths. Graveman retains interstices between even the short and long hammers, and extends comb fingers into these interstices as well. These interstices produce the very drawback that the current invention seeks to address; namely, that fingers of hardwoods can protrude into the interstices and bind against the drive mechanism or shaft.

The wood-pulping industry has similarly attempted to maximize the efficiency of its shredders, though these shredders tend to rely upon finely sharpened cutting blades, as opposed to the more durable and robust hammermills of the present invention, which must be capable of operating under conditions that prevent maintenance of sharp blades. Nevertheless, examination of attempts in the wood-pulping industry is instructive, as it demonstrates further difficulties. U.S. Pat. No. 4,077,450, issued to Ackerman, discloses the use of "leading feet" (FIG. 6 and 3: 38–50). These leading feet operate as ramps which extend into the interstices between the main cutting elements, but not so far as to contact a shorter evening knife, which runs the length of the cutting drum. The main cutting elements cut a staggered pattern into the material, which staggering is then evened out by the evening knife. Initially, the ramps taught by Ackerman urge material into close contact with the barrel of the mill drum. This is necessary and desirable in pulping because the sharp blades are oriented to slice through thin slivers of material. Such a close arrangement in a true hammermill unacceptably promotes the frictional binding the art seeks to avoid.

Furthermore, the shorter evening knife of Ackerman does not prevent binding of the material against the mill. In fact, the evening knife exacerbates the difficulty with down-striking hammermills, because when an item of material enters the mill substantially parallel to its axis of rotation, the mill will bind if the blade is unable to overcome the resistive force of the material—the fact that Ackerman's evening knife runs the full length of the drum, extending to an identical distance above the drum at one point on the circumference causes the full length of the drum to meet the pressure of material at a single point in its rotation. The pressure accumulated at this single point is likely to overcome the motive force of the hammermill, causing jamming. As noted, a hammermill must be capable of operating while dull, which dullness makes jamming even likely in this configuration. Additionally, Ackerman is limited to situations that attempt to avoid lengthwise entry of material into the mill area. Ackerman is further limited to delicate situations in which the mill can possess sharp blades for cutting (such as the evening knife). Any attempt to run the Ackerman mill as a waste-reducer would rapidly dull the blades and cause significant jamming.

Similarly, Logan U.S. Pat. No. 3,219,076, discloses a pulping preparation shredder. While Logan teaches the use of staggered and shorter offset cutting surfaces, the reference further relies upon the need to have delicate, non-crushing blades that will not damage wood fibers. (1:14–36). Also, Logan indicates that it is important for cuts to be made parallel to the grain, as in Ackerman. These limitations significantly reduce the application of the Logan apparatus. Furthermore, Logan fails to realize that the unrestricted entry of material in a substantially parallel orientation to the hammermill is to be avoided.

BRIEF SUMMARY OF THE INVENTION

An apparatus has been discovered which is of value for grinding and debris-reduction. In brief, the invention is a hammermill grinder that eliminates the frequent jamming caused when hammermill cutting heads catch on material that is being fed into the lower segment of the rotary cutting arc and then feed at a rapid rate equal to the rotation of the the hammermill into and under the hammermill plates, where such material may frequently jam or obstruct the operation of a traditional hammermill. Specifically, the present invention is directed to a hammermill, preferably spinning on a horizontal axis of rotation, bearing a plurality of cutting surfaces disposed at a plurality of cutting depths, and further optionally employing "shredders" to limit the depth of cut, to prevent wide items from entering fully into the grate area, and to influence material into the cutting area.

Other objects of the invention are the ability to control the amount of material entering a hammermill parallel to the axis of the hammermill's rotation, to prevent jamming, while at the same time preventing frictional binding of material against the hammermill body.

One object of the present invention is to provide a down-running horizontal hammermill that is resistant to jamming and binding.

Another object of the present invention is to enable the apparatus to efficiently use a variety of sharpnesses of cutting heads.

Yet another object of the invention is to provide a safe and efficient hammermill.

The present invention overcomes the shortcomings of the prior art background with respect to horizontally disposed hammermills by, in addition to presenting other features and capabilities which are described herein or which shall be apparent to those skilled in the art, providing the following:

(1) A double-cut system on the hammermill cutting mechanism, which leaves substantially no interstices void of the effect of cutting heads;

(2) The presence of "shredders," which operate (a) to prevent material oriented substantially parallel to the axis of rotation of the hammermill from being pulled into the area between the hammermill and the grate without first being broken up; (b) to prevent jamming of the hammermill due to entry below a given point in the cutting radius of material oriented substantially parallel to the axis of rotation of the hammermill, while leaving no interstices void of cutting heads; (c) to urge material to be broken into smaller sections by the exertion of resistive force against one side of a portion of material and a complimentary area void of force at an adjacent and opposite side of the material, which void is in line with a main cutting head to exert force in a direction opposite to that of the shredder feet; and (d) to urge material up into the cutting path of the hammermill.

Each of these features is described in more detail below, with reference to the numbered aspects of the accompanying drawings. Additional aspects and advantages will be obvious to those skilled in the art, and are considered a relevant part of this disclosure.

BRIEF DESCRIPTION OF THE DRAWINGS

The foregoing and other objects, features and advantages of the present invention will be made apparent from the following detailed description of the preferred embodiment of the invention, and from the drawings, in which.

DETAILED DESCRIPTION OF THE INVENTION

It will be appreciated by those skilled in the art that various modifications within the spirit of the invention may be made to the embodiments disclosed herein for purposes of illustration. The invention is not to be limited to those particular embodiments, but only by the scope of the appended claims and their equivalents.

In recognition of the propensity of hammermills to bind upon material that becomes wedged between the cutting heads of the hammermill and the frame or backing grate of the comminuting machine apparatus, the conventional wisdom in the art is that material fed to a horizontal hammermill must be fed to the hammermill's upstroke side (e.g., as viewed in profile, if a hammermill is rotating clockwise, the material to be horizontally fed must enter the cutting radius from the left). The present invention overcomes this limitation by the addition of shredder feet and a double-cut hammermill. The following is a description of the preferred embodiment.

1. Shredder Feet

Figure 1:
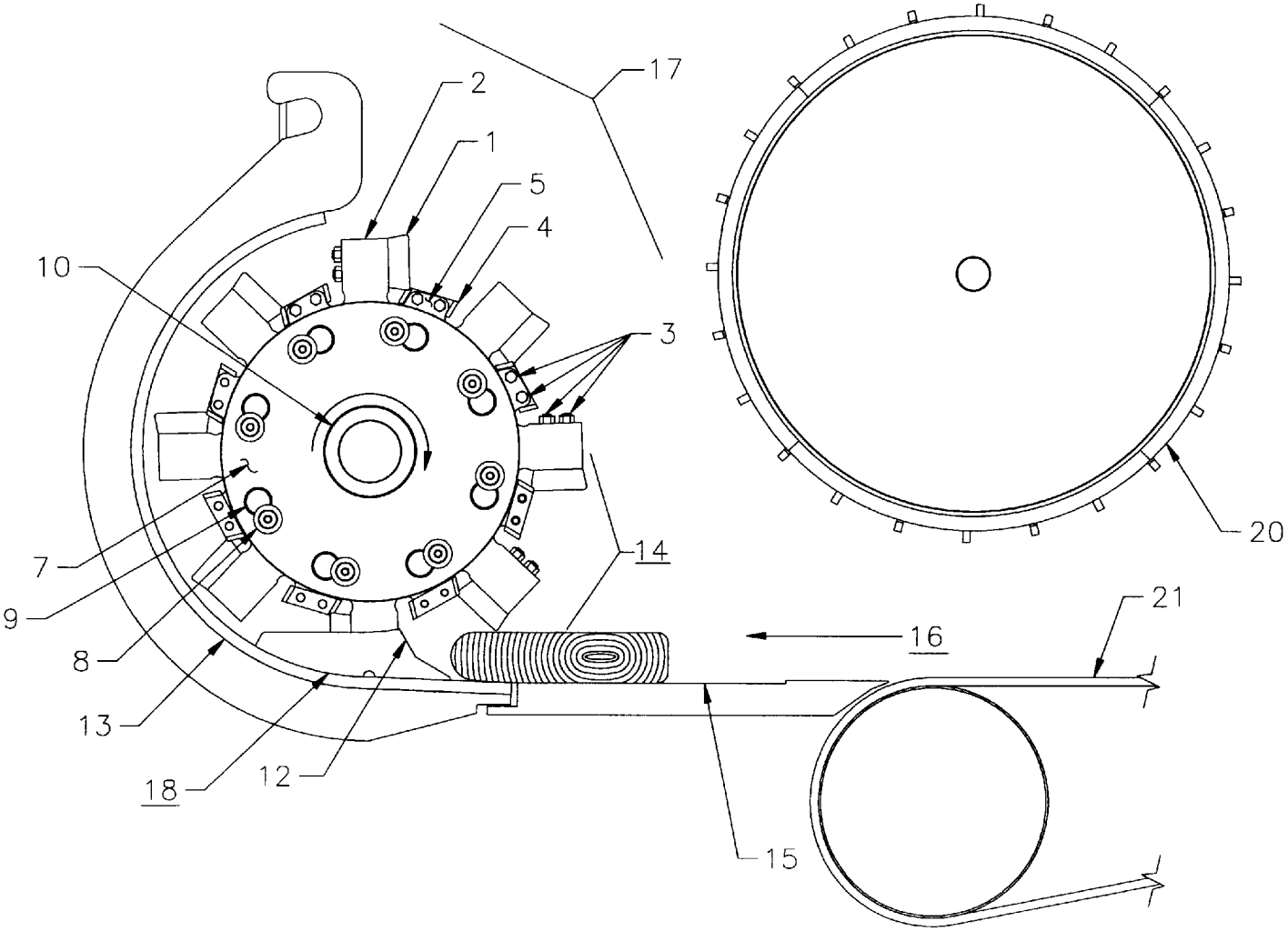
FIG. 1 is a side view of the hammermill in the preferred embodiment, omitting drive mechanisms and other connecting features and elements that are obvious to those skilled in the art.
Figure 10B:
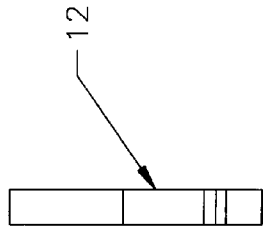
FIG. 10 displays an alternative shredder foot embodiment for grinding material such as palm leaves.
Figure 10A:
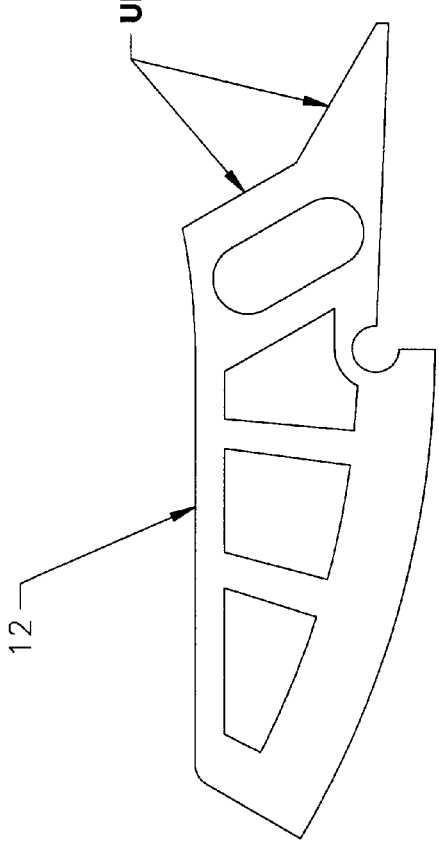
Figure 10:
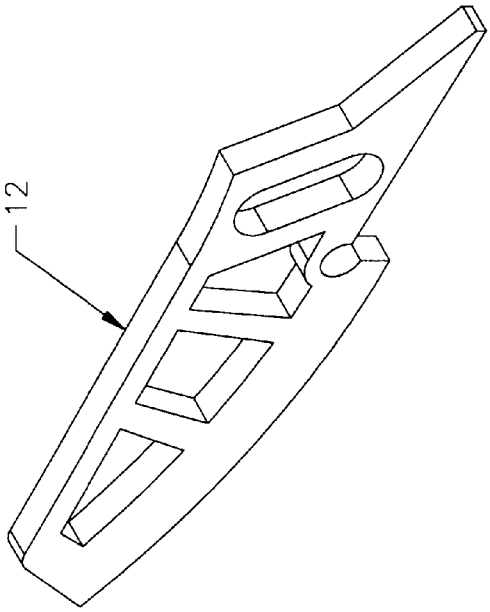
Figure 11B:
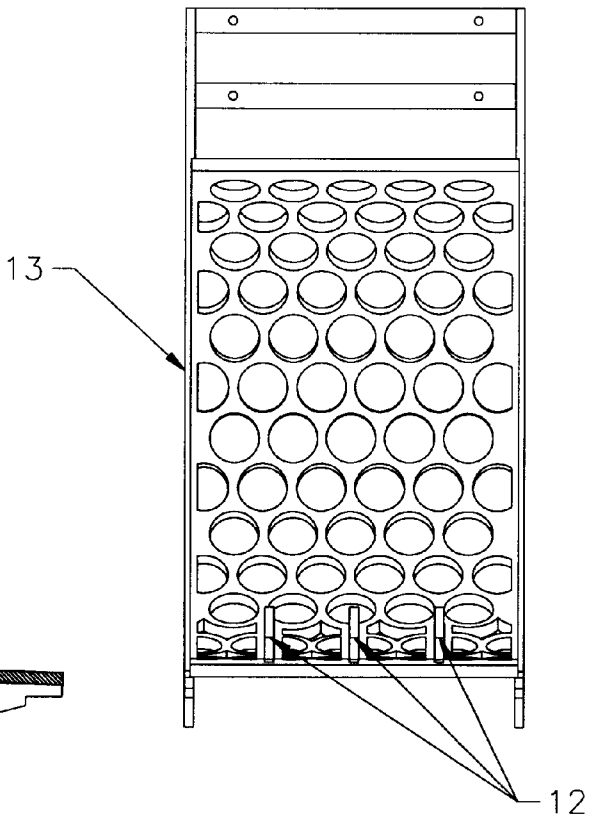
FIG. 11 demonstrates the preferred placement and arrangement of shredder feet when such feet are secured to a releasable back-grate.
Figure 11A:
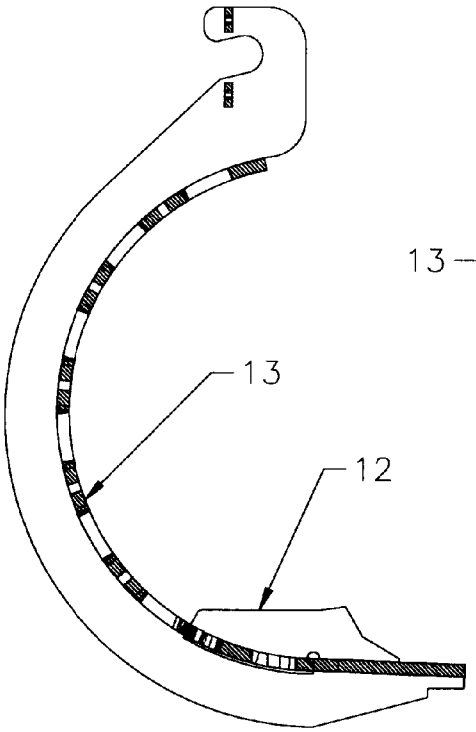
Figure 11:
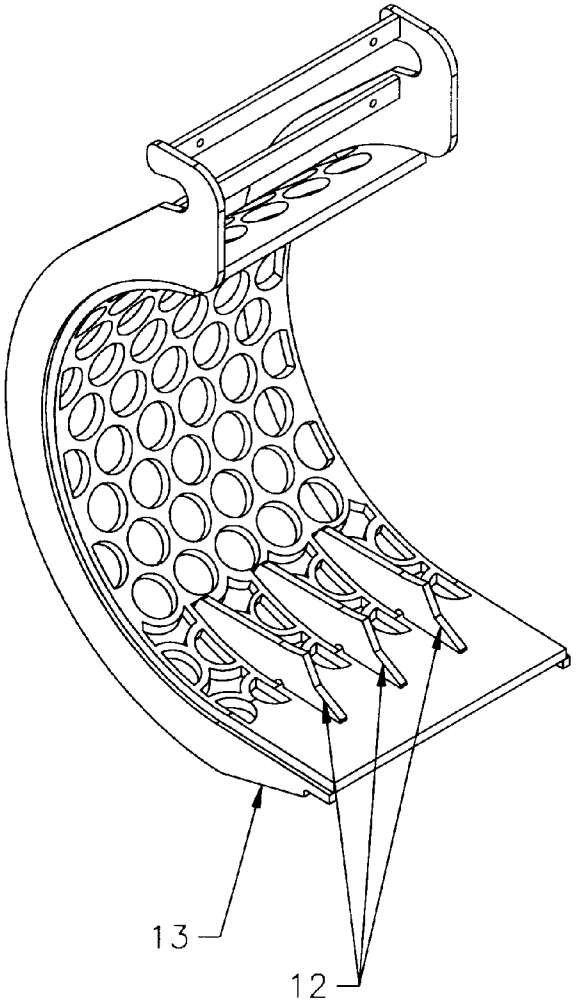
Figure 12:
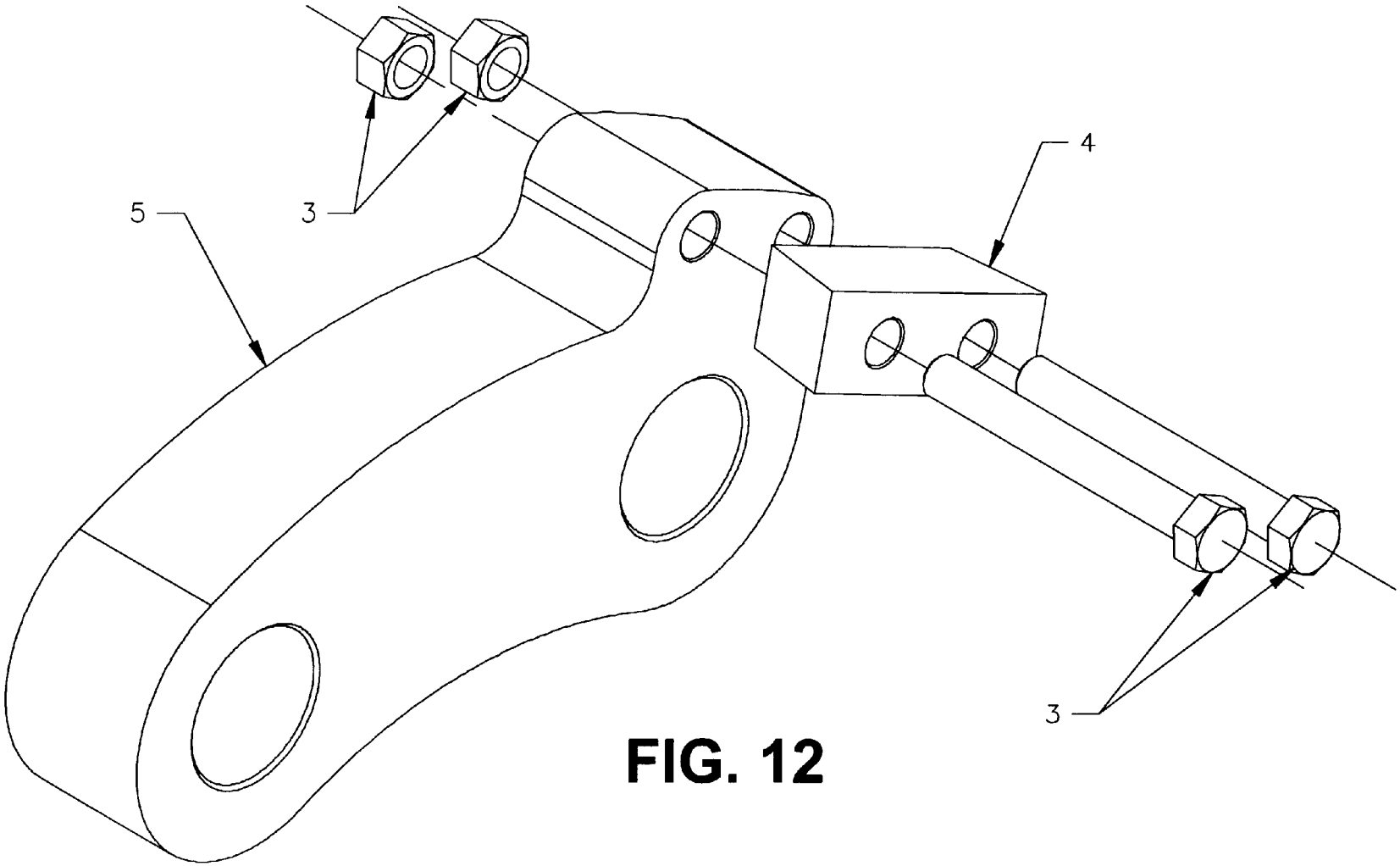
FIG. 12 details the preferred construction of a secondary attachment block and secondary cutting head.
Figure 13:
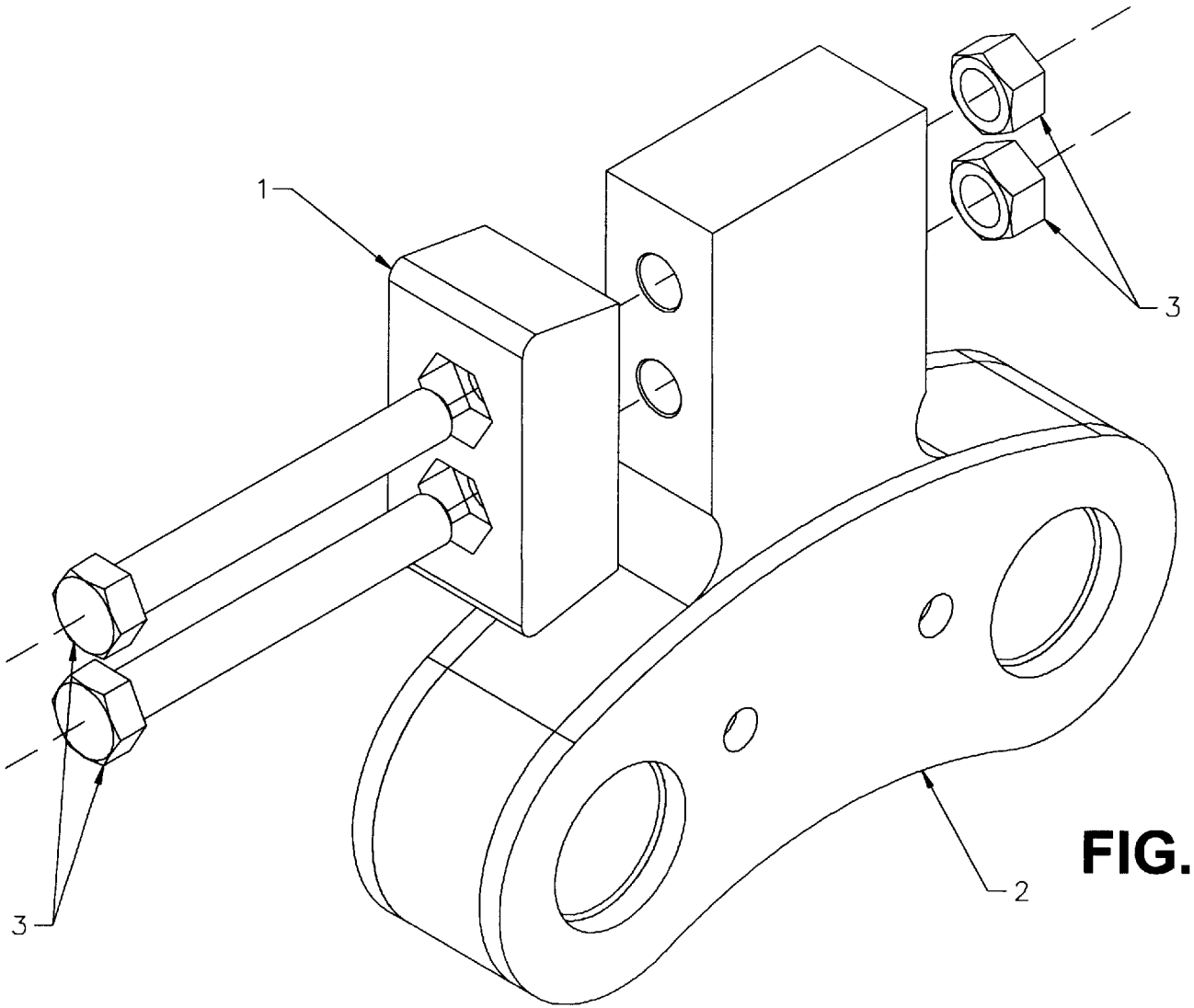
FIG. 13 details the preferred construction of an attachment block and primary cutting head.
Figure 14:
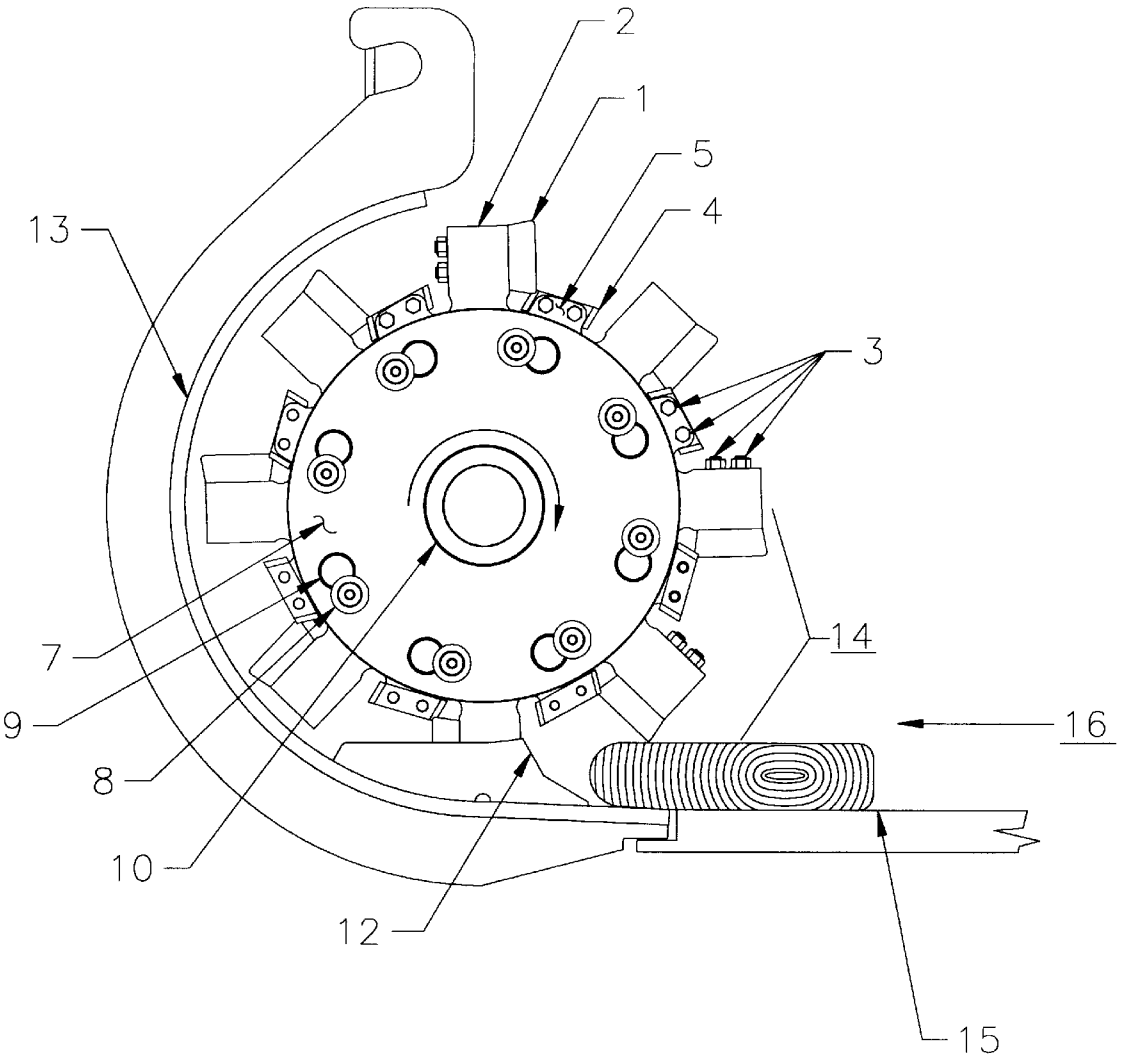
FIG. 14 shows a close-up of the hammermill of the present invention.
Figure 15:
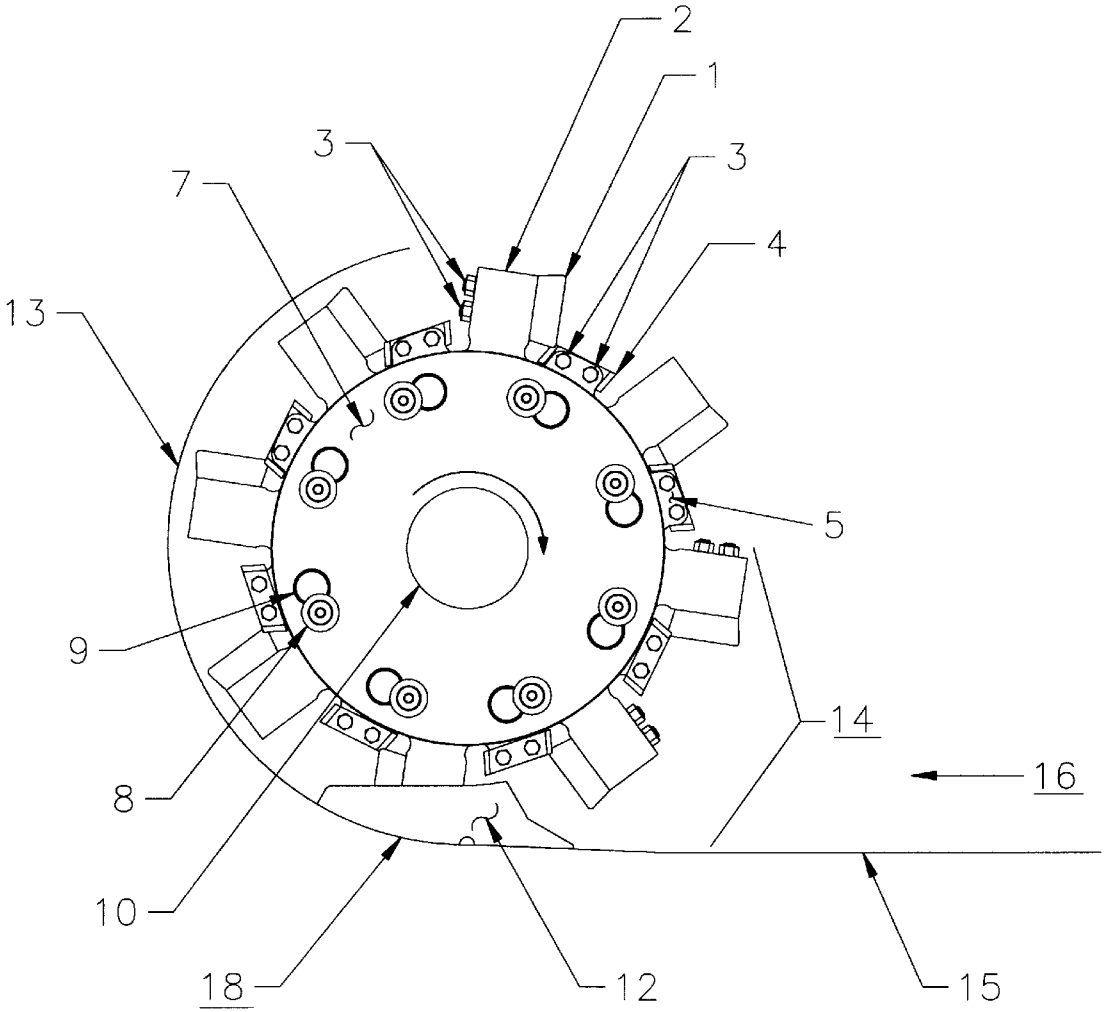
FIG. 15 shows an additional diagram of the hammermill of the present invention, indicating that platform 15 and backing grate 13 can be constructed as a single unit, each being an extension of the other.

As can be seen clearly in FIG. 1, floor 15 of the comminuting machine precedes (as seen from the direction of flow 16 of the material to be comminuted) hammermill 17. Preceding the first point of closest spacial relation 18 between hammermill 17 and backing grate 13, shredder feet 12 protrude from backing grate 13 into cutting area 14, which shredder feet 12 are substantially parallel to direction of flow 16 of input material. The inventors understand and contemplate that those reasonably skilled in the art may construct the apparatus such that platform 15 extends a sufficient distance beneath hammermill 17 to allow attachment of shredder feet 12 to platform 15 rather than backing grate 13. Shredder feet 12 reside under the leading edge of the hammermill 17 in a manner such that primary cutting heads 1 of hammermill 17 pass to either side of each shredder foot 12. The presence of shredder feet 12 allows long items to enter hammermill cutting area 14 only in a substantially lengthwise orientation and urges material longer than the spacing between adjacent shredder feet 12 to be fed upwards and into the cutting radius. In the absence of shredder feet 12, material can enter cutting area 14 perpendicular to direction of flow 16, and jam hammermill 17 by becoming wedged between primary cutting heads 1 or primary cutting head supports 2 and platform 15 of the comminuting machine or any backing grate 13. With shredder feet 12 attached, material that attempts entry into cutting area 14 in a parallel orientation is either broken by the pressure of at least one of primary cutting heads 1 on one side of material and at least one shredder foot 12 on an opposite side, or is urged upwards along the incline of the shredder feet into the cutting radius of hammermill 17 (see FIG. 10). As also shown in FIG. 10, shredder feet 12 may be optionally constructed with cut-outs along the profile, which cut-outs increase the number and orientation of cutting angles and surfaces to further reduce material as it passes between the shredder feet 12 and primary cutting heads.

It should be noted that a shredder foot is not necessary in every interstitial space for the invention to have practicable utility. In the inventor's most preferred embodiment, for reasons not essential to the invention, the inventors construct backing grate 13 of two adjacent grates, which join nearly in line with the midline of hammermill 17. Due to the meeting of the grates at this point, no shredder foot is employed in the middle-most interstitial space. Furthermore, no shredder feet are positioned in line with the two outermost disks 7. It will be evident to those skilled in the art that the presence of shredder feet among the interior disks 7 operates to maintain the effectiveness of the invention, and that the number and spacing of shredder feet can be varied within the teaching of this invention to accomodate cost, material, engineering, and convenience concerns.

2. Secondary Hammermill Cut

Figure 4:
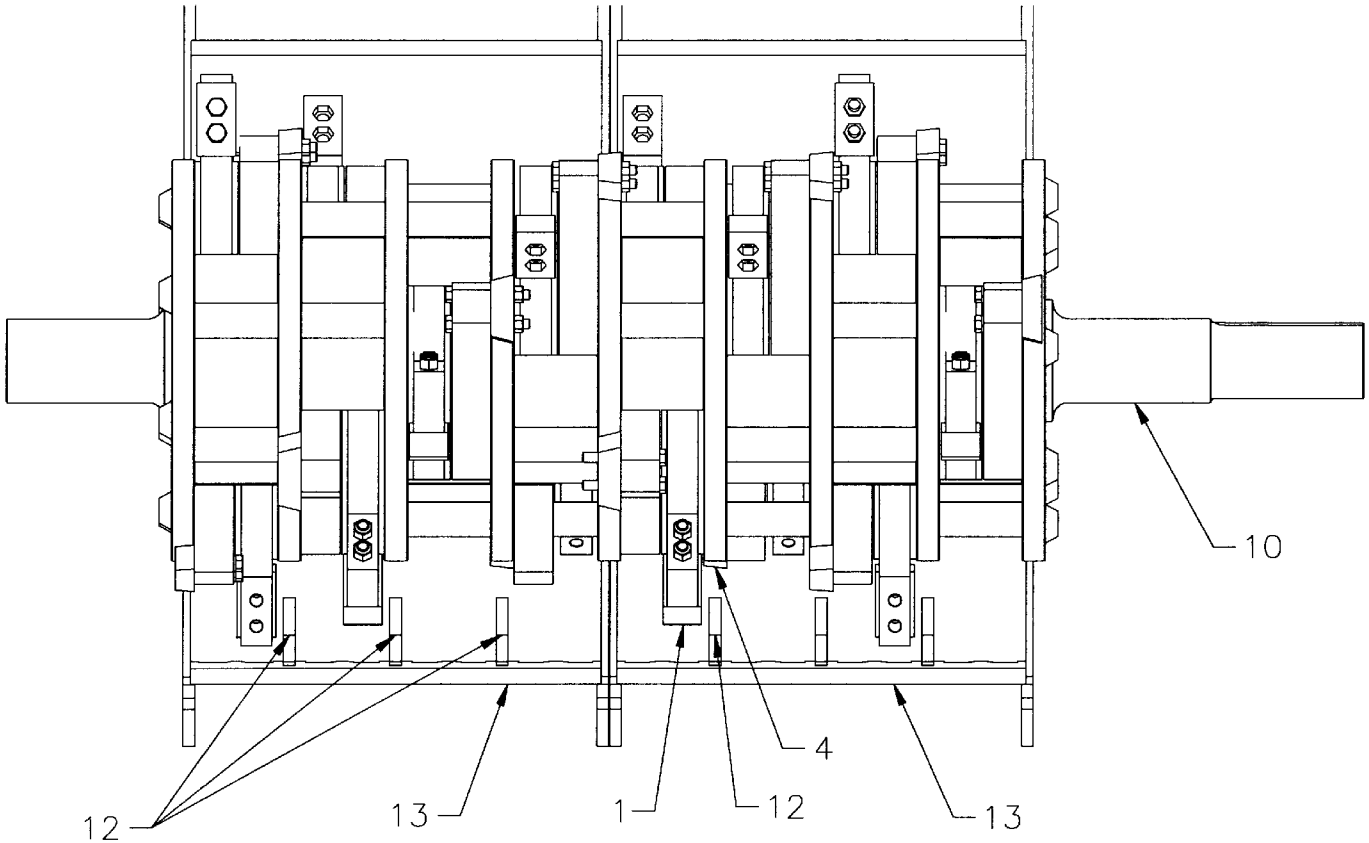
FIG. 4 is a view of the hammermill apparatus as seen looking into the throat of the hammermill along the direction of material in-feed.
Figure 4A:
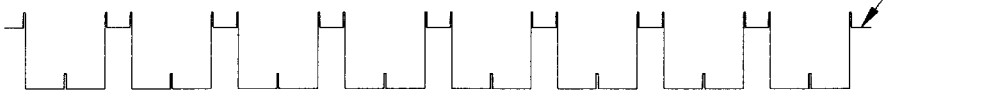
Figure 5:
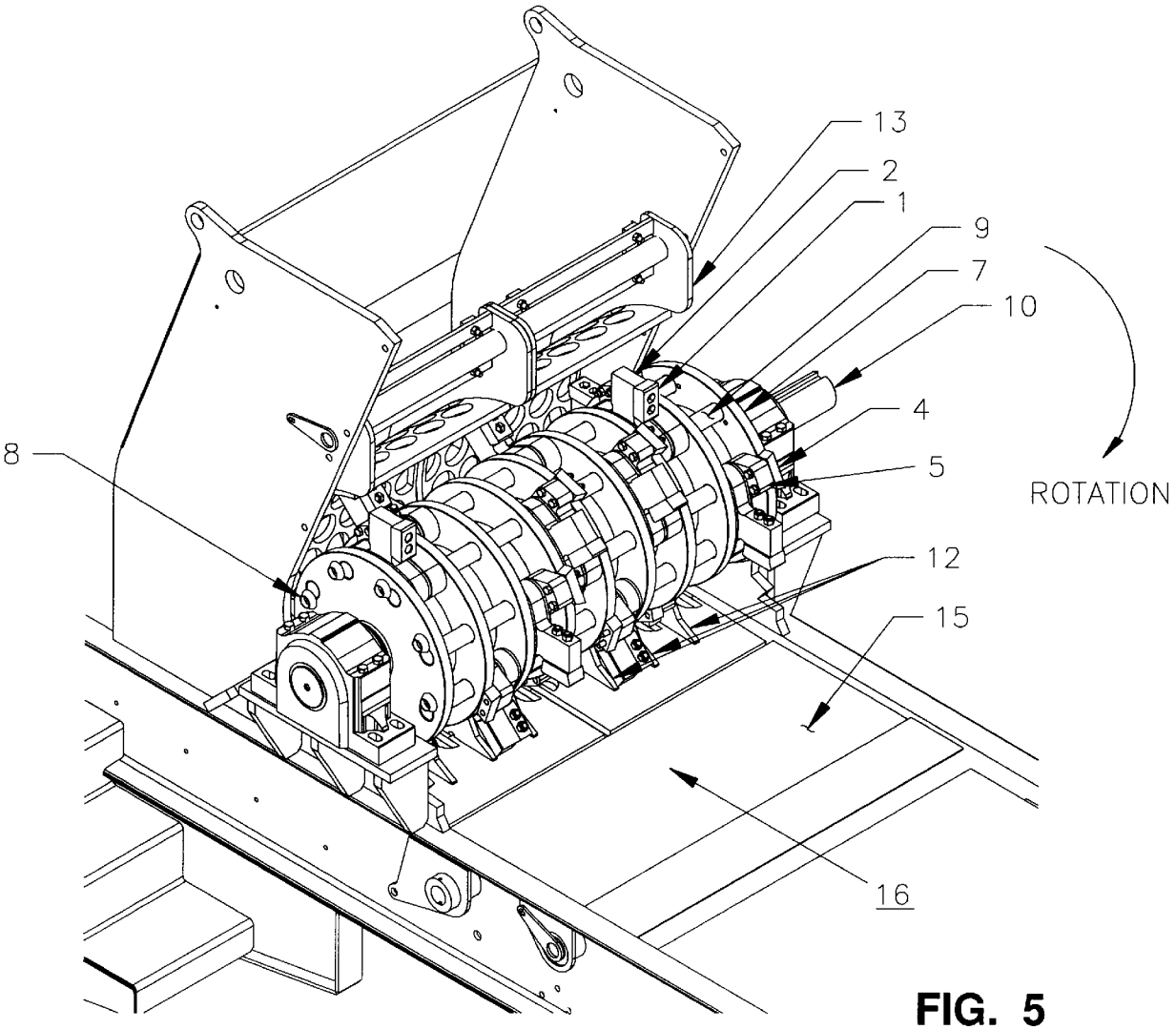
FIG. 5 is a perspective depiction of the down-running hammermill apparatus of the present invention.
Figure 6B:
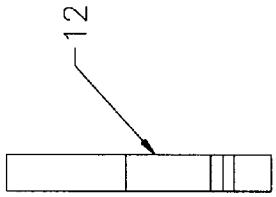
FIG. 6 is a depiction of a shredder foot of the present invention, as it would appear if detached from the apparatus.
Figure 6A:
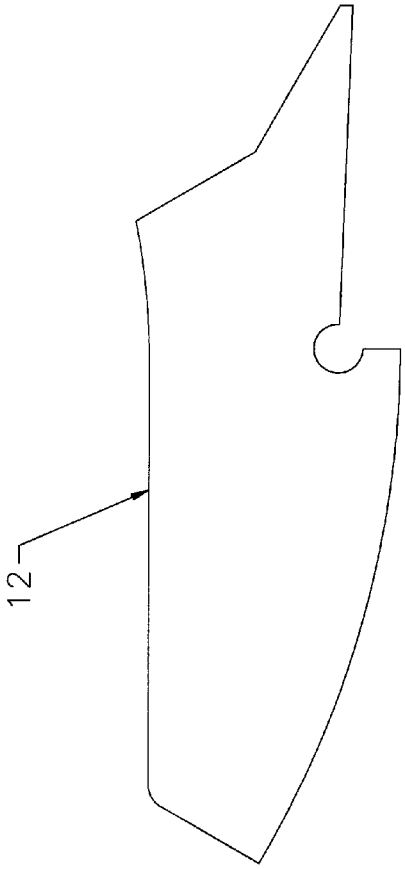
Figure 6:
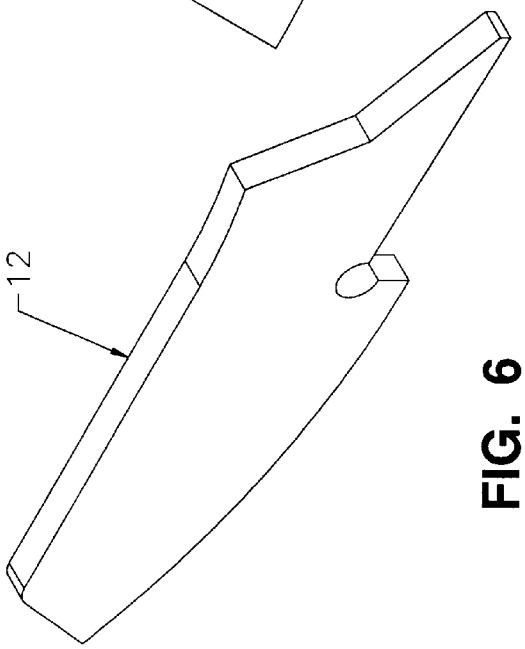
Figure 16:
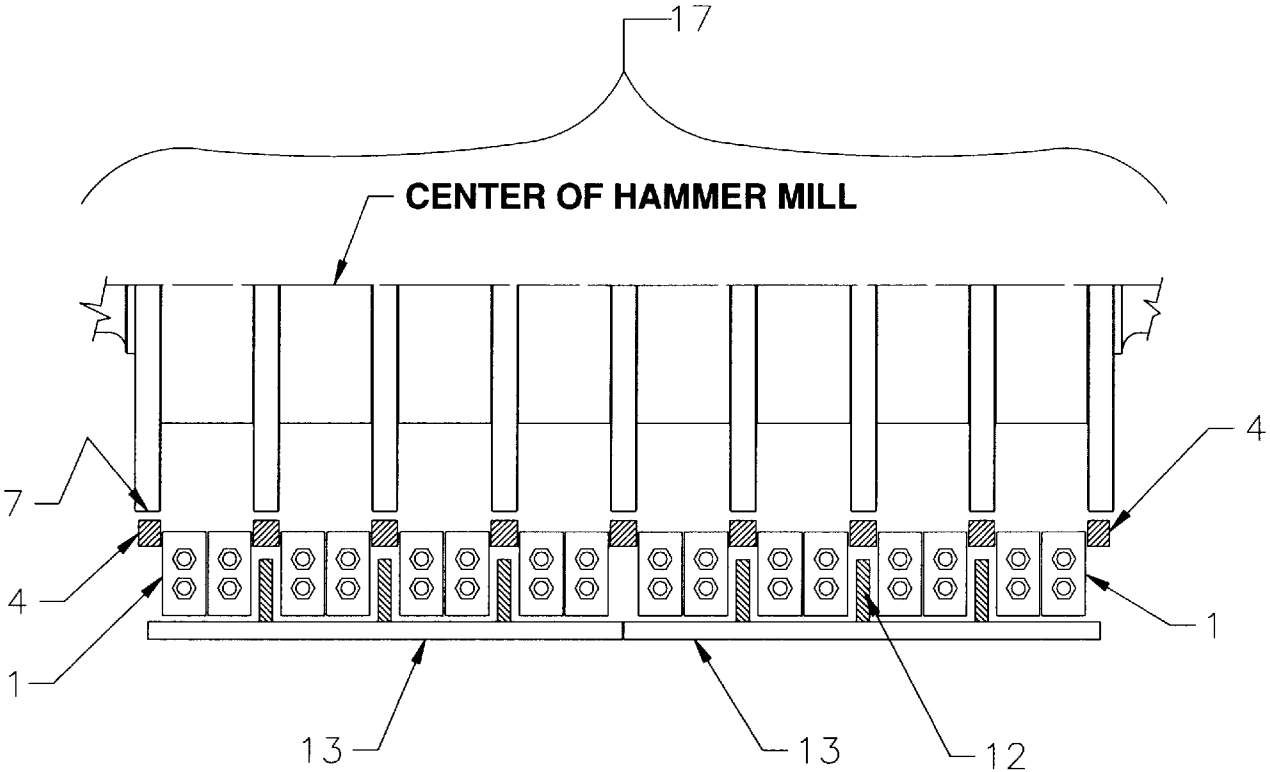
FIG. 16 depicts the linear spatial relationship among all cutting heads and shredder feet, as if the heads were located to one point on the radius of the hammermill; also shown is the cut pattern produced by this relationship.
Figure 16A:
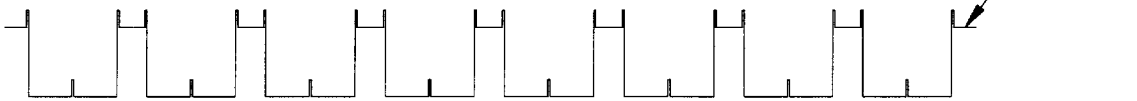

Due to the presence of shredder feet 12 in the preferred embodiment, primary cutting heads 1 of hammermill 17 cannot protrude to their full length along the entire cutting face of hammermill 17. Of necessity, primary cutting heads 1 must be spaced apart in a manner that leaves gaps within which shredder feet 12 fit (FIGS. 4, 6, and 16). Otherwise, primary cutting heads 1 would strike shredder feet 12, causing obvious damage to the comminuting machine. These gaps create the aforementioned potential that hardwoods may retain unbroken "fingers" extending into the gap. To prevent such fingers of hardwoods and other material from jamming against hammermill plates 7, or such alternate drive mechanism or non-cutting elements as may be present, in these interstitial spaces within which fit shredder feet 12, smaller secondary cutting heads 4 are placed on the outer diameter of hammermill disks 7 or such other drive mechanism or non-cutting elements as may be present. Secondary cutting heads 4 protrude a short enough distance that they do not strike shredder feet 12, but a sufficient distance to cut material that would otherwise bind against hammermill disks 7 or non-cutting elements under feeding pressure. These secondary cutting heads 4 operate to cut away material that fits within the interstitial spaces among primary cutting heads 1, before binding can occur. It should be noted that in the inventor's most preferred embodiment, some slight interstitial spaces do remain (See FIG. 16). These spaces are preferred to allow for manufacturing and assembly tolerances, but are not so great as to allow interstitial fingers of wood to remain intact. It will be readily apparent to those skilled in the art that the force of cutting heads is effective upon material immediately adjacent to the area of cutting head strike, which material is torn away. The amount of spacing tolerable between cutting heads is necessarily dependent upon the physical characteristics of the material being shredded, the bluntness of the cutting heads, and the velocity of rotation of the hammermill. The inventors have found that a spacing of a few milimeters is tolerable for typical hardwood applications, while spacing approaching one half-inch or more may result in uncut portions.

Figure 3:
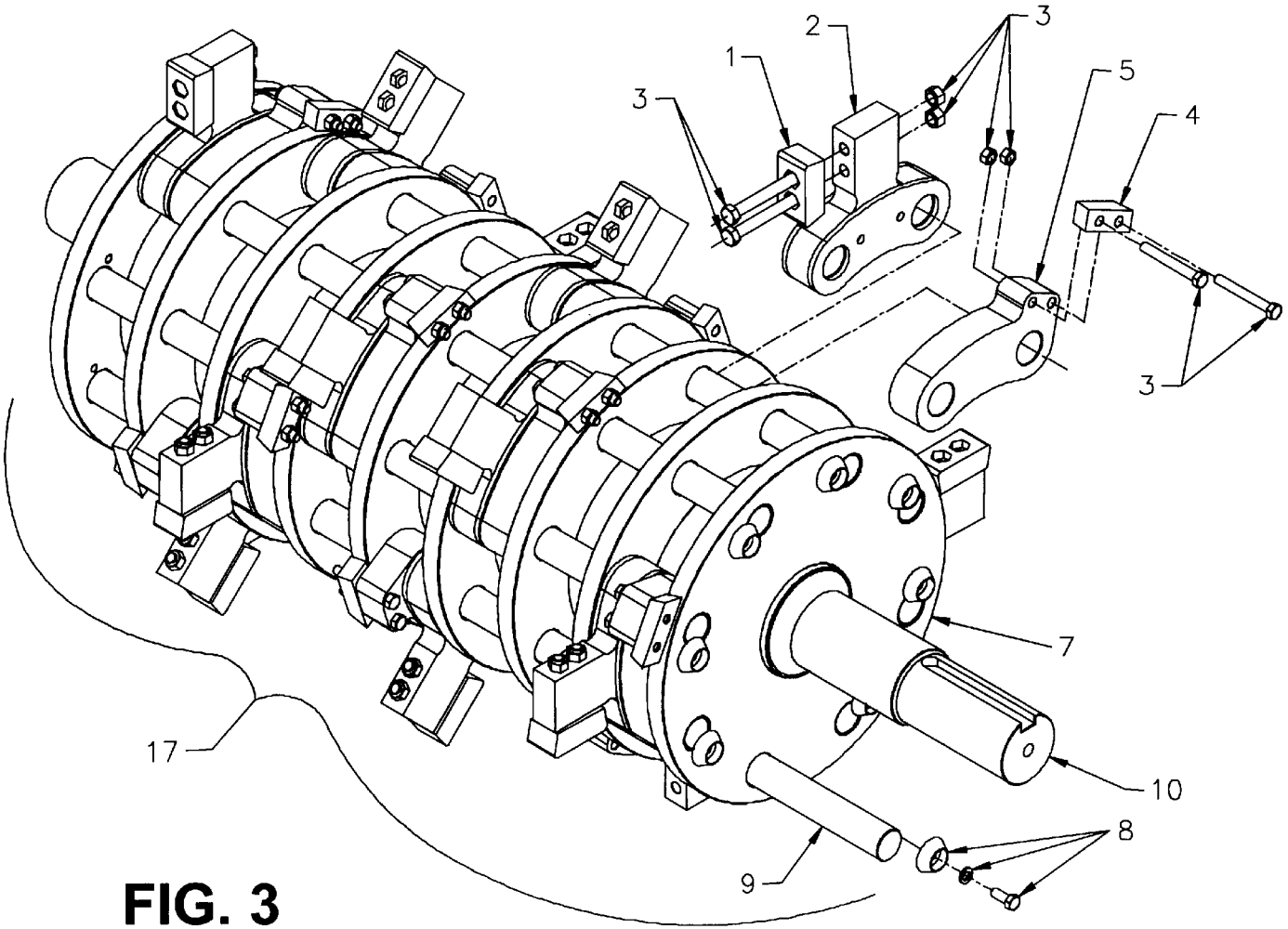
FIG. 3 is an exploded perspective view of the hammermill face.

In the most preferred embodiment, hammermill 17 is constructed of a series of disks 7 assembled to create a substantially cylindrical form (see, e.g., FIG. 3). Primary cutting heads 1 are attached to attachment blocks 2, which are in turn attached off-center of hammermill disks 7 by means of joining rods 9. For ease of maintenance and replacement of cutting heads, joining rods 9 are held into place by flange-screws 8, which secure to one of the two exterior hammermill disks 7 in such a manner that the flange of the screw head overlaps the opening through which joining rod 9 passes, preventing its removal until flange-screw 8 has been removed. For further ease of maintenance, cutting heads 1 are removably attached to attachment blocks 2 by means of fasteners 3, although it is to be understood that cutting heads 1 and attachment blocks 2 can be permanently joined, cast as a unit, or produced in any other manner that substantially maintains the operable presence of a cutting head 1. Similarly, hammermill disks 7 need not be actual disks, but may be of any configuration desired which is capable of operation as in the current invention. Such alternative configurations may include bars, triangles, or any other configuration desired by those reasonably skilled in the art. Inventors contemplate within this disclosure and within the claims that hammermill 17 could even be constructed in the form of a solid cylinder, a rotor, or a drum, so long as the operable presence of cutting heads is maintained.

Figure 8B:
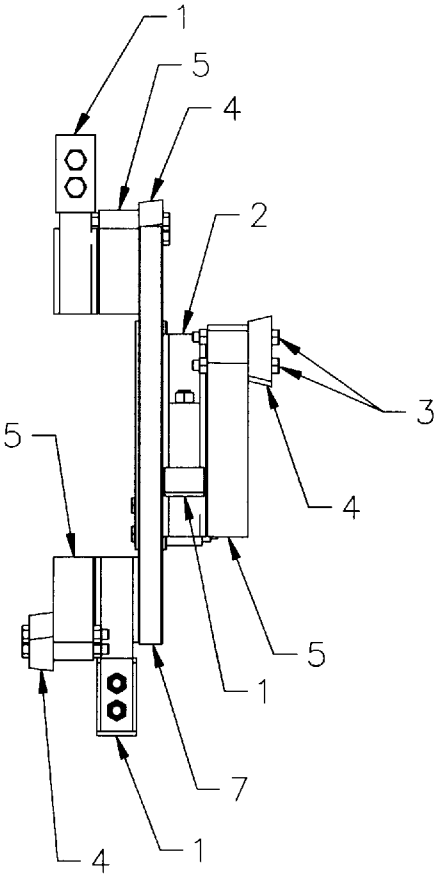
FIG. 8 shows an interior hammermill disk having cutting heads and attachment blocks positioned on each side.
Figure 8A:
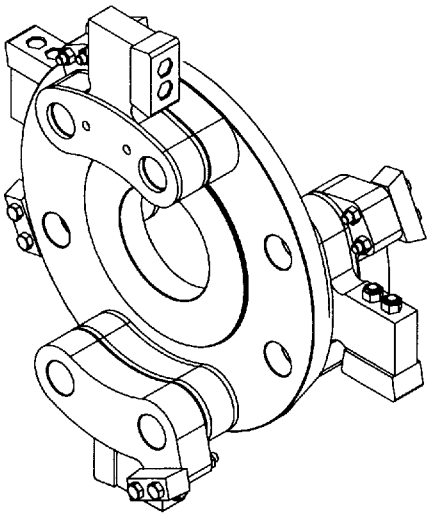
Figure 8:
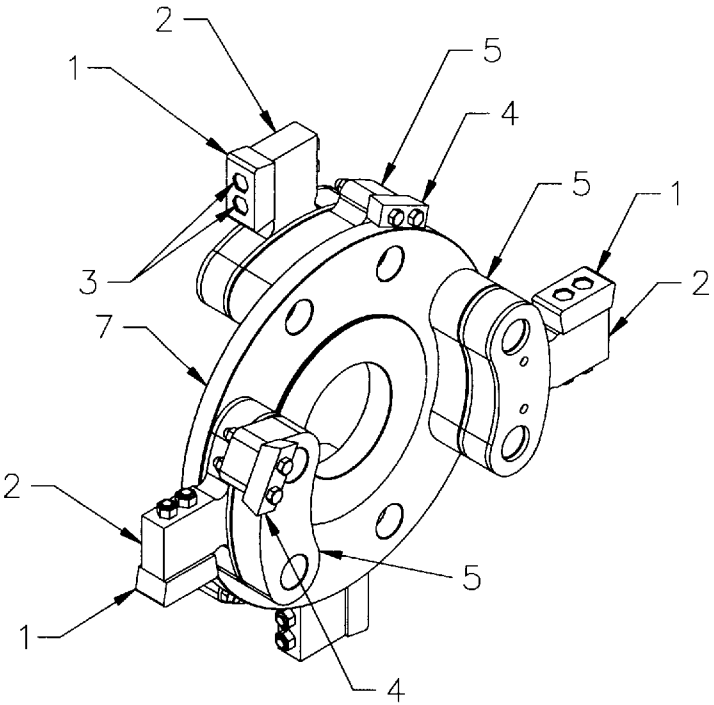

By this arrangement, primary cutting heads 1 extend further from the center of hammermill 17 than the edges of hammermill disks 7, and are positioned immediately or substantially adjacent to disks 7 when viewed from a facial orientation as in FIG. 16 along the line of the direction of material flow 16 as shown in FIG. 1. In the most preferred embodiment (with particular reference to FIG. 8), each disk 7 possesses on a first side one attachment block 2, (with associated cutting head 1) to which a secondary attachment block 5 (with associated secondary cutting head 4) is in turn attached on the side opposite disk 7. On the same side, each disk 7 also possesses at a location curcumferentially opposite the position of the attachment block 2 a secondary attachment block 5, (with associated secondary cutting head 4) to which an attachment block 2 (with associated cutting head 1) is in turn attached to secondary attachment block 5 on its side opposite disk 7. In assembly, the next disk 7 is positioned adjacent to the second side of the first disk 7 with its two sets of attachment blocks and secondary attachment blocks at positions not identical to the positions of the sets of attachment blocks and secondary attachment blocks on the first disk 7 (see, e.g., FIG. 9). By assembly of multiple disks 7 configured in this manner, each disk 7 except the two terminating end disks 7 will possess an attachment block 2 and a secondary attachment block 5 on each side. Furthermore, the rotational positioning of the disks 7 can be orchestrated to yield a successively "stair stepping" effect to the location of cutting heads 1 and secondary cutting heads 4. It will be readily obvious to those in the art that the overall configuration of the fully assembled hammermill 17 is preferred to be rotationally balanced. In this embodiment, secondary cutting heads 4 are positioned by secondary attachment blocks immediately upon and in-line with the circumferential face of disks 7, such that if viewed from the direction of material in-flow, the secondary cutting heads would appear to be directly overlapping disks 7.

Figure 7B:
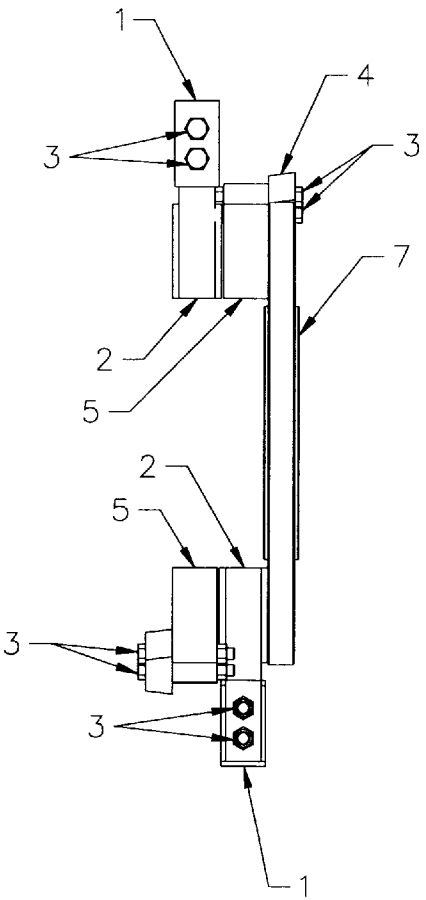
FIG. 7 shows an interior hammermill disk of the preferred embodiment, depicting the most preferred location of the cutting heads and attachment blocks on one side only.
Figure 7A:
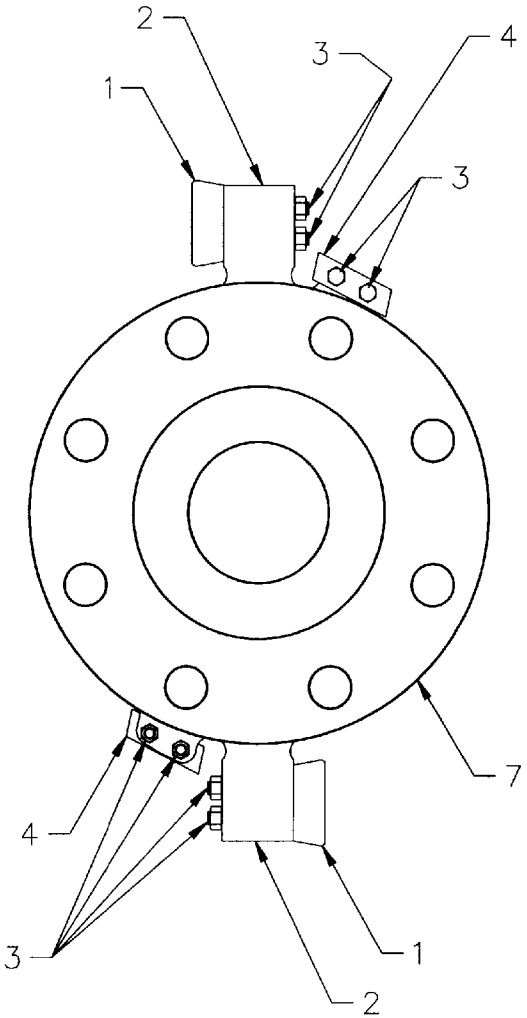
Figure 7:
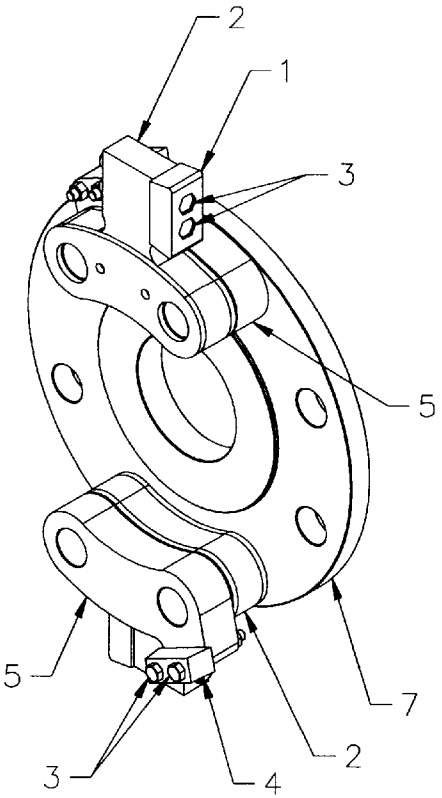

In an alternate embodiment, each interior disk 7 possesses one attachment block 2 at a first position on its circumference on its first side, and further possesses a second attachment block 5 on a second, immediately opposite position on its circumference on its opposite, second side (FIG. 7). By this configuration, each interior disk 7 is substantially rotationally balanced as is understood in the art to prevent "wobble" that may be associated with unequal distribution of weight along the circumference of a hammermill disk 7. Secondary cutting heads 4 are attached to secondary attachment blocks 5, which are in turn attached to hammermill disk 7 at a location preferably distinct from the location of attachment of attachment block 2, such that the position of primary cutting heads 1 and secondary cutting heads 4 on the circumference of disk 7 are distinct. The arrangement of secondary attachment blocks 5 and secondary cutting heads 4 on disk 7 is preferably similar to the arrangement of attachment blocks 2 and primary cutting heads 1, in that each secondary attachment block 5 and secondary cutting head 4 should be located on the circumference of disk 7, which are opposite the location on the circumference of disk 7 of a complimentary secondary attachment block 5 and secondary cutting head 4. In contrast to the attachment of primary cutting heads 1 and attachment blocks 2, this alternate embodiment contemplates the location of secondary cutting heads 4 immediately upon and in-line with the circumferential face of disks 7.

Figure 9B:
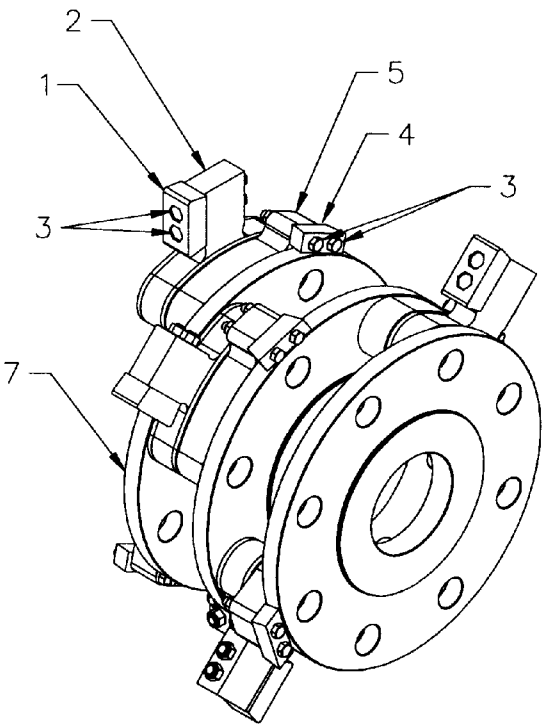
FIG. 9 is a depiction of three hammermill disks assembled along with attachment blocks and cutting heads.
Figure 9A:
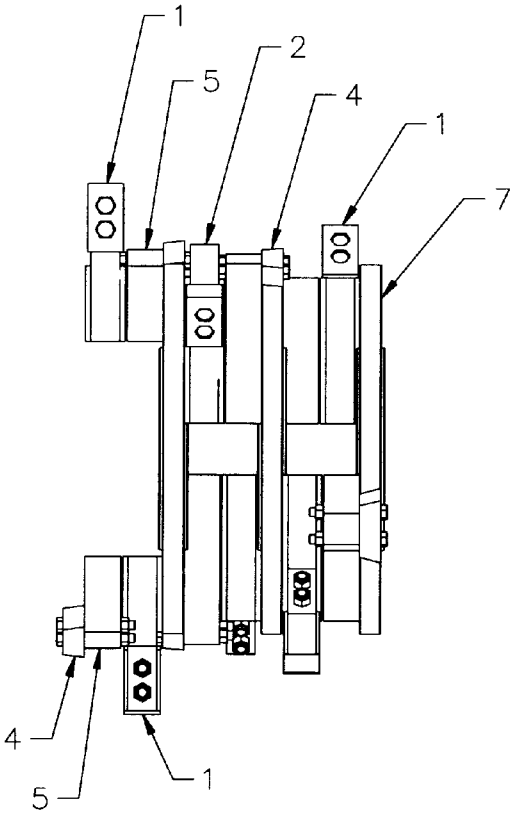
Figure 9:
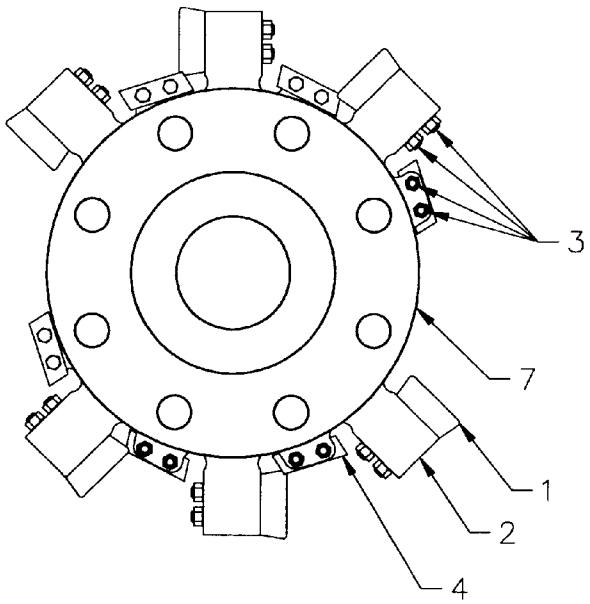

The combination of several hammermill disks 7 with attached attachment blocks and cutting heads can be seen in FIG. 9. It is most preferred that the locations of placement of attachment blocks 2 and primary cutting heads 1 on each incremental disk 7 are offset from the locations of placement on each preceding disk 7, such that cutting heads 1 appear to stair-step along the length of hammermill 17 when a plurality of disks 7 with associated attachment blocks 2 and primary cutting heads 1 are connected in series along the length of joining rods 9. The same preference for stair-stepping configuration is carried over to the locations of secondary attachment blocks 5 and secondary cutting heads 4 in the most preferred embodiment, applying the same placement criteria. Finally, in the most preferred embodiment, the two outermost hammermill disks 7 possess attachment blocks 2 and primary cutting heads on only the inner-most side, although those skilled in the art will understand that this feature, as with each description in the most preferred embodiment, is subject to alteration and substitution depending upon the purposes and operating conditions of the comminuting machine.

Figure 2:
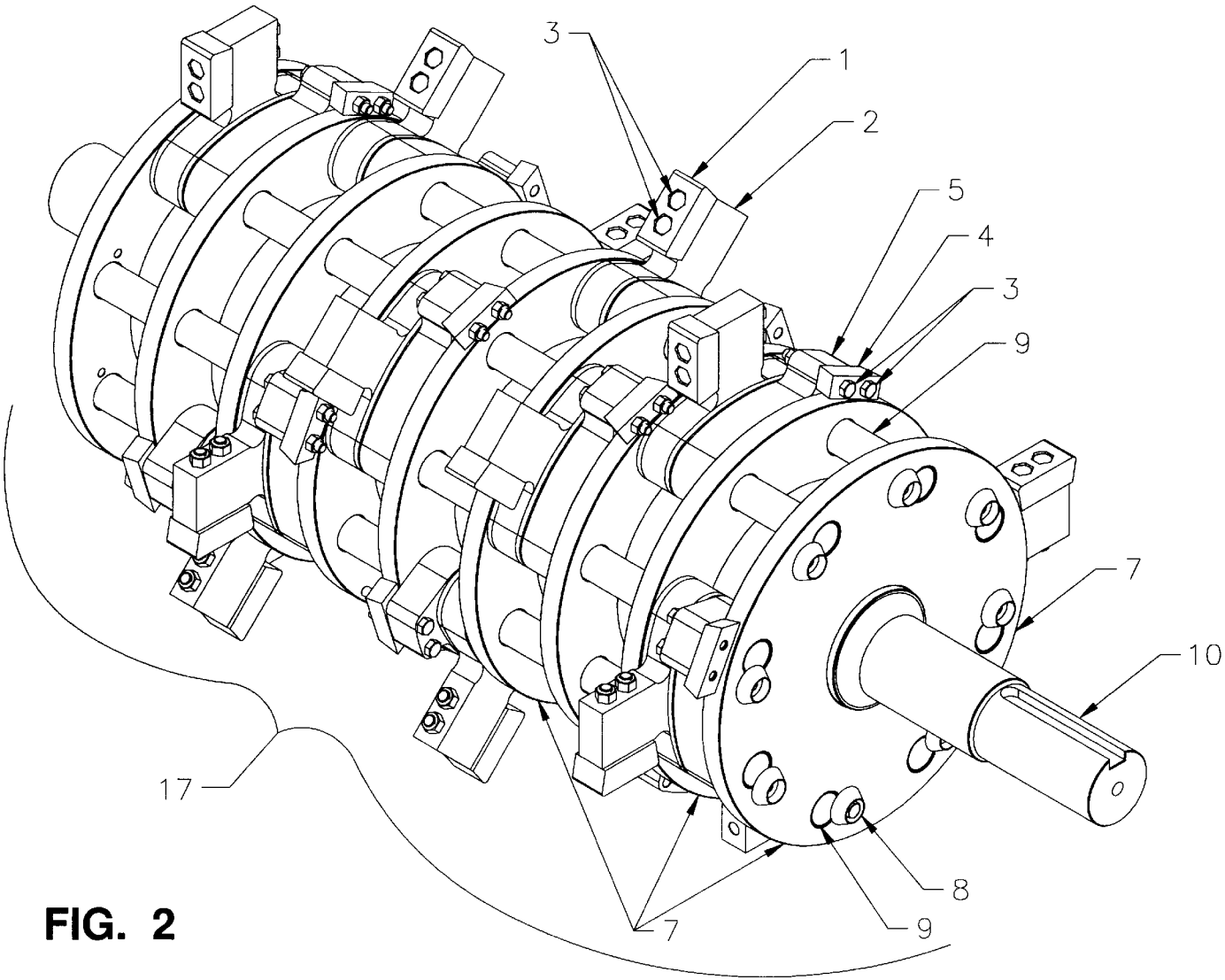
FIG. 2 is a perspective view of the hammermill face, showing primary cutting heads and secondary cutting heads, along with the most preferred mode of construction.

In this most preferred embodiment, hammermill 17 possesses a center drive-shaft 10 (see FIG. 2), which passes through all hammermill disks 7. Drive-shaft 10 is operably connected to a drive means of known type for causing rotation of hammermill 17 at desired velocities of rotation, which velocities may depend to the desired applications. Drive shaft 10 further supports hammermill 17 slightly above platform 15. The direction of rotation of hammermill 17 causes primary cutting heads 1 to strike in-fed material in cutting area 14 just above platform 15 immediately prior to passing by point 18. As is understood in the art, material that is drawn along with cutting heads 1 and hammermill 17 is compressed either against platform 15 or backing grate 13. This compression causes further breakage of the material, or drives portions through the openings in backing grate 13. Operation of shredder feet 12 substantially prevents large, uncut, material from being pulled into the area between backing grate 13 and hammermill 17, where such material may cause jamming in the conventional art if it is too large or too resilient to be reduced by the force of the hammermill.

Upon rotation of drive shaft 10, by drive means (not shown) hammermill 17 rotates, causing each cutting head 1 and secondary cutting head 4 to describe a substantially circular cutting circumference. Because of the differing radial lengths of cutting heads 1 and secondary cutting heads 4, the cutting circumference of an assembled set of disks 7 with accompanying attachment blocks and cutting heads possesses alternating depths of cutting, such that the view of the combined cutting circumference (as viewed, for example, from above) appears as a gap-toothed cutting face (see 19). See FIG. 16. Shredder feet 12 reside in-line with the gaps in this cutting face, being substantially in line with secondary cutting heads 4, which, as described above, are in turn substantially in-line with disks 7.

Finally, to maximize efficiency, the inventors contemplate the inclusion of a material feed drive mechanism of the type traditionally known in the art. Such a mechanism can most preferably be a down-pressing roller-drive 20, which urges material into close relation to platform 15, or may be a plunger-drive, which forces material from behind its direction of in-flow, or a conveyor system 21. As with other aspects of the invention, any substitute understood by those in the art may be employed, to the extent that the drive mechanism may be even gravity itself, allowing a reduction of costs by the exclusion of additional machinery.

It must be understood that, though the most preferred embodiment of the invention contemplates a down-running horizontally fed hammermill, the principles of the invention are applicable to up-running hammermills and to hammermills in which in-feed is from a vertically oriented chute or hopper, or from some other orientation. The description of the most preferred embodiment is not intended to limit in any way the scope of the claims or the disclosure; rather, substantial advantages, potential substitutions, or different embodiments will be apparent to those skilled in the art, and should be considered within the scope of this disclosure.

What is claimed is:

1. A comminuting apparatus comprising a hammermill comprising a plurality of primary cutting heads that define a primary cutting radius when said hammermill is operationally rotated, said primary cutting heads being positioned along said hammermill such that said hammermill possesses at least one interstitial space between a first primary cutting head and a next adjacent primary cutting head, which interstitial space remains void of a primary cutting head; said apparatus further comprising a shredder foot extending into at least one said interstitial space, said shredder foot being capable of urging at least a portion of material to be comminuted toward entry into the primary cutting radius at a point earlier in the rotation of said hammermill than any second point at which said portion would enter the primary cutting radius in absence of said shredder foot.

2. The comminuting apparatus as in claim 1, further comprising a secondary cutting head, which secondary cutting head is recessed within said interstitial space by a distance of recess, whereby said secondary cutting head defines a secondary cutting radius, which is concentric with and smaller in radius than said primary cutting radius.

3. The comminuting apparatus as in claim 2, wherein said shredder foot extends into said interstitial space by a distance less than the distance of recess, whereby said shredder foot extends within said primary cutting radius, but does not extend within said secondary cutting radius.

4. The comminuting apparatus as in claim 2, wherein said shredder foot extends into said interstitial space at a location subsequent in rotational direction to an in-feed location at which a substantial amount of material to be comminuted is initially struck by said primary cutting head.

5. The comminuting apparatus as in claim 2 wherein said shredder foot is mounted upon a platform which is substantially parallel to an axis of rotation of said hammermill, and wherein further said hammermill rotates in a direction such that said primary cutting head passes through a cutting area substantially immediately before passing by said shredder foot.

6. The comminuting apparatus as in claim 2 wherein said shredder foot is mounted upon a floor platform which is substantially parallel to an axis of rotation of said hammermill, and wherein further said hammermill rotates in a downward direction toward said shredder foot.

7. A comminuting apparatus comprising a hammermill and a machine body housing said hammermill, said hammermill further comprising a plurality of primary cutting heads and a plurality of secondary cutting heads, said primary cutting heads defining a primary cutting radius when said hammermill is operationally rotated, and said secondary cutting heads defining a secondary cutting radius when said hammermill is operationally rotated, which secondary cutting radius is concentric with and interior to said primary cutting radius, said apparatus further comprising a plurality of shredder feet attached to a platform connected by connecting means to said machine body, which platform is disposed adjacent to said hammermill, said shredder feet being attached to said platform substantially in line with said secondary cutting heads and extending substantially along a direction of in-feed of material into an area between said primary cutting radius and said secondary cutting radius, whereby said primary cutting heads pass alongside said shredder feet without striking said shredder feet.

8. The comminuting apparatus as in claim 7, wherein said primary and secondary cutting heads linearly alternate, with at least one said secondary cutting head between at least two said primary cutting heads, whereby a cutting pattern along a cutting face of the hammermill possesses shallow cuts corresponding to the secondary cutting radius of said secondary cutting heads and deeper cuts corresponding to the primary cutting radius of said primary cutting heads.

9. The Comminuting apparatus of claim 7, wherein said shredder feet are capable of urging at least a portion of material to be comminuted away from said platform.

* * * * *